US011794946B2

(12) United States Patent
Melvan et al.

(10) Patent No.: US 11,794,946 B2
(45) Date of Patent: *Oct. 24, 2023

(54) VENTED CONTAINER FOR HOUSING A SCENTED PRODUCT AND RELATED METHODS

(71) Applicant: THE GLAD PRODUCTS COMPANY, Oakland, CA (US)

(72) Inventors: Jack F Melvan, Willowbrook, IL (US); Sarah A Kuhl, Willowbrook, IL (US); Justin Zickus, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/148,191

(22) Filed: Dec. 29, 2022

(65) Prior Publication Data

US 2023/0136192 A1 May 4, 2023

Related U.S. Application Data

(63) Continuation of application No. 16/684,211, filed as application No. PCT/US2018/032663 on May 15, 2018, now Pat. No. 11,608,207.

(Continued)

(51) Int. Cl.

| | |
|---|---|
| ***B65D 5/42*** | (2006.01) |
| ***B65B 5/02*** | (2006.01) |
| ***B65D 5/54*** | (2006.01) |

(52) U.S. Cl.

CPC ..... *B65D 5/4295* (2013.01); *B65B 5/024* (2013.01); *B65D 5/5455* (2013.01)

(58) Field of Classification Search

CPC ..... B65D 5/4295; B65D 5/5455; B65D 2203/12; B65D 2205/02; B65D 85/02

(Continued)

(56) References Cited

U.S. PATENT DOCUMENTS

| | | | |
|---|---|---|---|
| 1,527,830 | A | 2/1925 | Booker |
| 3,302,844 | A | 2/1967 | Warren |

(Continued)

OTHER PUBLICATIONS

International Search Report & Written Opinion as received in PCT/US2018132663 dated Aug. 10, 2018.

(Continued)

*Primary Examiner* — Christopher R Demeree
(74) *Attorney, Agent, or Firm* — Keller Preece PLLC

(57) ABSTRACT

A container for housing scented product includes a bottom wall, a top wall, a plurality of longitudinal sidewalls, and a plurality of lateral sidewalls. The container further includes a scented product disposed within the cavity and a first plurality of selectively openable and closable vents extending through the top wall of the container. The first plurality of vents is configured to at least partially open when a force is applied to one or more of the plurality of longitudinal sidewalls and the plurality of lateral sidewalls of the container. The container further includes a second plurality of selectively openable and closable vents extending through the bottom wall of the container. The second plurality of vents are configured to at least partially open when the force is applied to one or more of the plurality of longitudinal sidewalls and the plurality of lateral sidewalls of the container.

20 Claims, 14 Drawing Sheets

Related U.S. Application Data

(60) Provisional application No. 62/510,655, filed on May 24, 2017.

(58) Field of Classification Search
USPC ..... 229/120, 120.1, 150, 116.1; 206/303, 206/485; 220/367.1, 676, 913
See application file for complete search history.

(56) References Cited

U.S. PATENT DOCUMENTS

| | | | |
|---|---|---|---|
| 4,280,649 | A | 7/1981 | Montealegre |
| D330,414 | S | 10/1992 | Creswell |
| 5,472,281 | A | 12/1995 | Phelps |
| 5,529,243 | A | 6/1996 | Hoyt et al. |
| D399,298 | S | 10/1998 | Whitehead |
| 5,965,182 | A | 10/1999 | Lindgren et al. |
| 5,965,183 | A | 10/1999 | Hartal et al. |
| 6,631,852 | B1 | 10/2003 | O'Leary |
| 9,138,502 | B2 | 9/2015 | Irvin et al. |
| 9,550,610 | B2 * | 1/2017 | Kent ..... B31B 70/00 |
| 10,351,293 | B2 | 7/2019 | Bader |
| 2008/0056959 | A1 | 3/2008 | Cuthbert |
| 2009/0065389 | A1 | 3/2009 | Kleinsmith |
| 2009/0261100 | A1 | 10/2009 | McMinn |
| 2010/0095902 | A1 | 4/2010 | Kuwa |
| 2013/0119059 | A1 | 5/2013 | Toh et al. |
| 2016/0009458 | A1 | 1/2016 | Diaz Mason |
| 2016/0242390 | A1 | 8/2016 | Lynch |
| 2017/0008261 | A1 | 1/2017 | Jean-Mary et al. |
| 2019/0023448 | A1 | 1/2019 | Mehta |

OTHER PUBLICATIONS

U.S. Appl. No. 16/684,211, Mar. 31, 2021, Office Action.
U.S. Appl. No. 16/684,211, Jan. 27, 2022, Office Action.
U.S. Appl. No. 16/684,211, Apr. 5, 2022, Office Action.
U.S. Appl. No. 16/684,211, Oct. 27, 2022, Office Action.
U.S. Appl. No. 16/684,211, Nov. 22, 2022, Notice of Allowance.
Examination Report as received in AU application 2018273141 dated May 25, 2023.

* cited by examiner

VENTED CONTAINER FOR HOUSING A SCENTED PRODUCT AND RELATED METHODS

CROSS-REFERENCE

This application is a continuation of U.S. patent application Ser. No. 16/684,211, filed Dec. 14, 2019, which claims the benefit of PCT International Application No. US2018/32663, filed on May 15, 2018, which claims the benefit of and priority to U.S. Provisional Application No. 62/510,655, filed on May 24, 2017. The disclose is herein incorporated by reference in its entirety.

BACKGROUND

Consumers often face confusion and frustration when trying to purchase scented products (e.g., scented trash bags) that are available in a wide variety of fragrances. For example, without testing the scented products, the consumer cannot know whether the consumer will like the fragrance of the scented product. Some efforts to remedy the above problem include scratch and sniff regions included on the packaging of scented products. However, the scratch and sniff regions often to not accurately reflect the fragrance of the scented products. As a result, consumers can become frustrated (e.g., disappointed) when they do not receive the scented product they expected from the scratch and sniff regions.

Additionally, scratch and sniff regions are typically relatively costly to produce. Furthermore, scratch and sniff regions typically have a very limited amount of available fragrance (e.g., a limited number of uses hat provide an accurate scent). Accordingly, consumers are often left wondering what the scented product smells like because the scratch and sniff region has expired (e.g., been used up).

Accordingly, there are a number of considerations to be made in scented products and the ability to provide consumers an accurate test of a scented product's fragrance.

BRIEF SUMMARY

One or more embodiments of the present disclosure may include a vented container for housing a scented product. The vented container can allow a potential consumer to selectively experience a scent of the product prior to purchasing or opening the container. In one or more embodiments, the container may include a bottom wall, a top wall, and a plurality of side walls extending upward from the bottom wall. The bottom wall, top wall, and the plurality of side walls defining one or more cavities of the container. The container may further include a scented product disposed within one or more cavities within the container. The container may further include a plurality of selectively openable vents extending through one or more of the walls of the container to the one or more cavities. The vents are configured to at least partially open when a force is applied to one or more of the walls of the container.

Further embodiments of the present disclosure include a method of making a container for housing a scented product. The method may include forming a first plurality of vents in a sheet of material, forming a second plurality of vents in the sheet of material, and folding the sheet of material to form a container such that vents of the first plurality of vents extend through a first wall of the container and vent of the second plurality of vents extend through an opposing wall of the container Additional features and advantages of will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above recited and other advantages and features of the present disclosure can be obtained, a more particular description of the present disclosure briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the present disclosure and are not therefore to be considered to be limiting of its scope, the present disclosure will be described and explained with additional specificity and detail through the use of the accompanying drawings in which.

DETAILED DESCRIPTION

Figure 1:
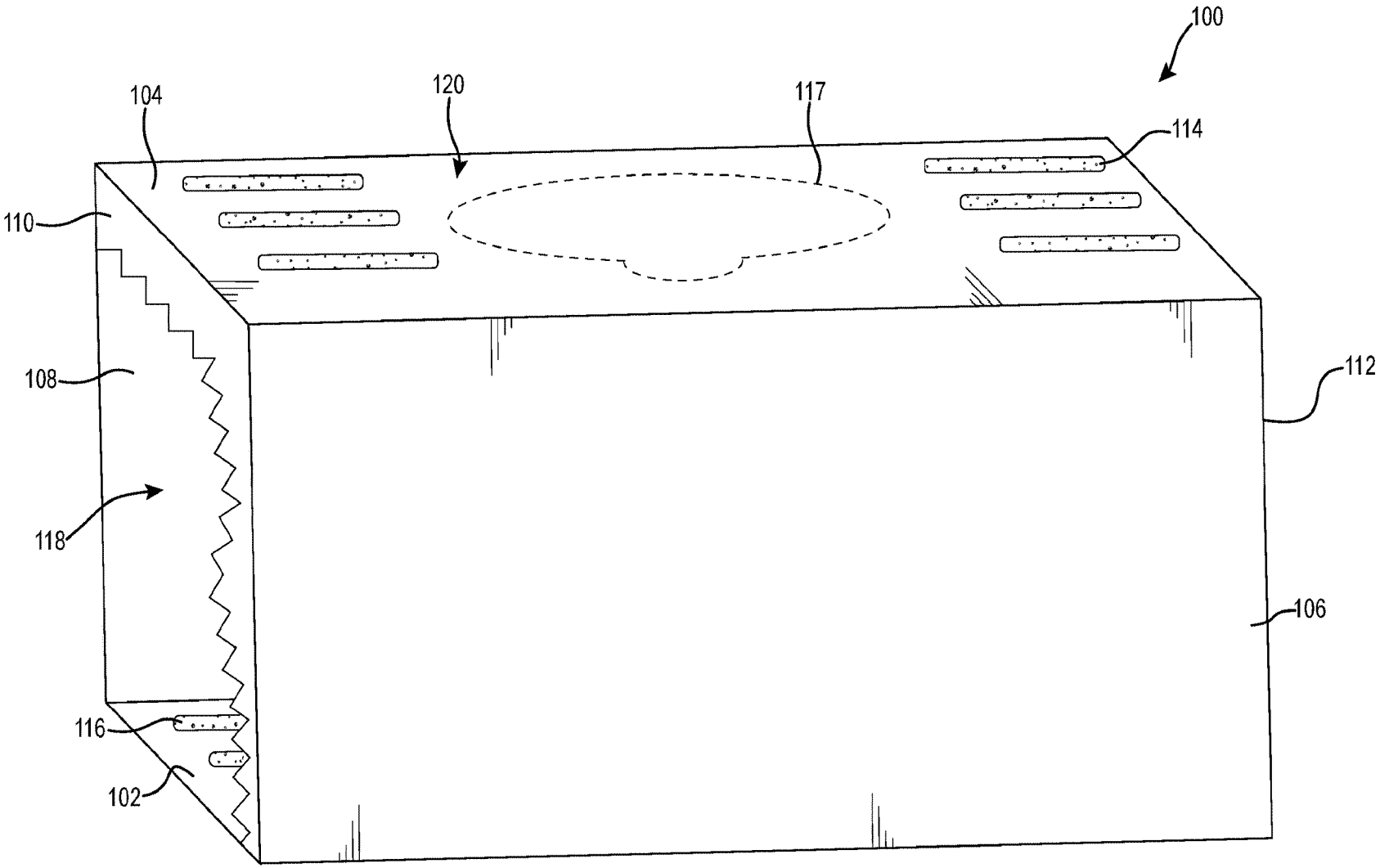
FIG. 1 shows a perspective view of a container for housing a scented product according to an embodiment of the present disclosure.

One or more embodiments of the present disclosure include a container (e.g., a carton or packaging) for housing a scented product (e.g., scented trash bags) that allows users (e.g., consumers) to accurately test (e.g., try out) an actual fragrance of the scented product disposed within the container without opening the container. For example, the container allows users to test out a fragrance of the scented product while at a store prior to purchasing the scented product.

In some embodiments, the container includes one or more selectively openable and closable vents extending through one or more walls of the container. For example, the container may include the one or more vents extending through a first wall of the container. Furthermore, applying a force to the container may open the one or more of vents. For instance, a user can open the one or more vents by squeezing the container. Moreover, by squeezing the container, the user may cause a puff of fragrance to pass through the one or more vents allowing the user to test (e.g., sniff) the fragrance of the scent product.

In one or more embodiments, the container includes a first selectively openable and closable vent extending through a first wall of the container and a second selectively openable and closable vent extending through an opposing wall of the container. Furthermore, similar to the one or more vents mentioned above, applying a force to the container may open both the first vent and the second vent. In particular, a user can open the both the first and the second vents by squeezing the container. Moreover, by opening both the first and the second vents, air may be permitted to enter the container through the second vent, pass over the scented product, and escape the container through the first vent. As a result, when a user sniffs the container, the user may experience a more potent amount of the fragrance of the scented product allowing to user to more accurately test the fragrance of the scented product.

Because the container allows a user to test the fragrance of the scented product, the container of the present disclosure is advantageous over conventional containers for housing scented products (e.g., scratch and sniff containers). For instance, unlike conventional scratch and sniff containers, which often do not accurately reflect the actual fragrance of the scented product inside of the container, the selectively openable and closable vent(s) of the container enables a user to accurately test the fragrance of the scented product prior to purchasing the scented product. Thus, the selectively openable and closable vent(s) of the container enable a user to find a scented product to the user's liking.

Furthermore, as will be readily recognized by one of ordinary skill in the art, by enabling a user to accurately find a fragrance to the user's liking (e.g., helping the user discover something that the user likes about the product), the selectively openable and closable vent(s) of the present disclosure will help encourage users to purchase the scented product, thus leading to additional sales and revenue. Moreover, by allowing a user to test fragrances of scented products, the container of the present disclosure is more likely to entice (e.g., persuade, encourage, etc.) a user to handle (e.g., interact with) the container (e.g., pick up the container off of a shelf at a store) and test the fragrance. Additionally, increased interaction with a product increases a likelihood that the user will purchase the product.

In comparison to conventional containers, which are costly to produce and which provide a relatively limited amount of available fragrance (i.e., a limited number of uses), the container of the present disclosure reduces cost by not having scratch and sniff regions and provides more available fragrance to test. Specifically, because a user is smelling the actual scented product instead of a scratch and sniff region, the available fragrance of the container of the present disclosure lasts longer than conventional containers and provides a more accurate sample of the actual fragrance of the scented product.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, any relational terms such as "first," "second," and "third," "interior," "exterior," "top," "bottom," "upward," etc. are for clarity and convenience in understanding the present disclosure and accompanying drawings and does not connote or depend on any specific preference, orientation, or order, except where the context clearly indicates otherwise. For example, the relational terms may refer an orientation of a container for housing a scented material while disposed on a planar horizontal surface (e.g., a store shelf).

FIG. 1 shows a container 100 (e.g., carton or box) for housing a scented product. The container 100 is illustrated with a portion removed to better shown internal elements of the container 100. The container 100 may include a bottom wall 102, a top wall 104, a plurality of lateral sidewalls 106, 108, a plurality of longitudinal sidewalls 110, 112, a first plurality of vents 114, a second plurality of vents 116, and a perforated opening 117. The plurality of lateral sidewalls 106, 108 may be disposed on lateral sides of the bottom wall 102 and the top wall 104, and the plurality of longitudinal sidewalls 110, 112 may be disposed on longitudinal sides of the bottom wall 102 and the top wall 104. Furthermore, the plurality of longitudinal sidewalls 110, 112 and the plurality of lateral sidewalls 106, 108 may extend upward from the bottom wall 102 and may, in conjunction with the bottom wall 102 defined a cavity 118 within the container 100. For example, the plurality of longitudinal sidewalls 106, 108 and the plurality of lateral sidewalls 110, 112 may extend between the bottom wall 102 and the top wall 104. Additionally, in one or more embodiments, a scented product (e.g., trash bags) (FIG. 2A) may be disposed within the cavity 118 of the container 100. Furthermore, the container 100 may include a perforated opening 117 extending through the top wall 104 of the container and that may be opened to allow a user to remove the scented product and/or portions of the scented product from the container 100.

The first plurality of vents 114 (e.g., slits, holes, apertures, indentions, etc.) may extend through one or more walls. For example, FIG. 1 illustrates an embodiment in which the first plurality of vents 114 extend through the top wall 104. In some embodiments, the first plurality of vents 114 may extend completely (e.g., entirely) through the wall in which they are formed (e.g., from an exterior surface 120 to an interior surface). In other embodiments, the first plurality of vents 114 may extend only partially through the wall in which they are formed. In such embodiments, the first plurality of vents 114 may extend at least substantially the wall in which they are formed.

The second plurality of vents 116 may extend through a wall opposite the wall in which the first plurality of vents 114 extend. For example, FIG. 1 illustrates the second plurality of vents 116 extending through the bottom wall 102. In some embodiments, the second plurality of vents 116 may extend completely (e.g., entirely) through the wall in which they are formed (e.g., from an exterior surface to an interior surface). In other embodiments, the second plurality of vents 116 may extend only partially through the wall in which they are formed. In such embodiments, the second plurality of vents 116 may extend at least substantially through the wall in which they are formed.

In one or more embodiments, the first plurality of vents 114 may be disposed proximate to longitudinal ends of the container 100. For example, the first plurality of vents 114 may extend through the top wall 104 at a region and/or regions of the top wall 104 proximate the longitudinal ends of the container 100. In other embodiments, the first plurality of vents 114 may be disposed proximate to a center region of the container 100. For instance, the first plurality of vents 114 may extend through the top wall 104 at a region of the top wall 104 proximate the center of the container 100. Similarly, the second plurality of vents 116 may be disposed proximate to the longitudinal ends of the container 100 in the same manners described above. In any event, in one or more embodiments, the vents are positioned to be at a point of maximum deflection of the container when a force is applied. For example, the container can be configured such that when squeezed, the middle of a wall of the container defects more than the sides or edges. The vents can be positioned at the point of maximum deflection of the container to help ensure that the vents open when the proper force is applied to the container.

Furthermore, although the first and second plurality of vents 114, 116 are illustrated in FIG. 1 as extending in a longitudinal direction (e.g., in a direction parallel to a longitudinal axis of the container 100), the disclosure is not so limited, and the vents of the first and second plurality of vents 114, 116 may extend in any direction.

To facilitate explanation of the present disclosure, the first plurality of vents 114 and second plurality of vents 116 may be referred to herein collectively as "the plurality of vents 114, 116". In some embodiments, each vent of the plurality of vents 114, 116 may be selectively openable and closable to permit a user to test (e.g., sniff) a fragrance of the scented product within the container. In particular, as will be discussed in greater detail below, the plurality of vents 114, 116 may be selectively opened by applying force to the container (e.g., the longitudinal 110, 112 and/or lateral sidewalls 106, 108). The plurality of vents 114, 116 may be selectively closed by removing the force from the sidewalls (e.g., releasing the container). As a non-limiting example, during use, the plurality of vents 114, 116 may open when a user (i.e., a consumer) squeezes the container 100, and the plurality of vents may close when the user releases the container 100. Operation of the plurality of vents 114, 116 is described in greater detail below in regard to FIGS. 2A-4B. In alternative embodiments, each vent of the plurality of vents 114, 116 may include an aperture extending through a wall of the container 100. For example, the plurality of vents 114, 116 may be permanently open. In further embodiments, each vent of the plurality of vents 114, 116 may include an aperture extending through a wall of the container 100 and a porous and/or breathable material disposed within the aperture such that fluids (e.g., air) can pass through the aperture and through the porous and/or breathable material. In some instances, the porous and/or breathable material can include materials having micro perforations such as TYVEK and/or GORTEX.

In one or more embodiments, the scented product may include one or more of scented trash bags, wraps, grocery bags, sacks, packaging materials, feminine hygiene products, baby diapers, adult incontinence products, or other products. Furthermore, the product may be scented with odor control components, such as, one or more of volatile fragrance materials (i.e., fragrance materials capable of being transported to the olfactory system) and deodorizing agents (e.g., deodorizing compositions with a deodorizing effect on offensive odors such as that associated with activated nitrogen compound, activated sulfur compounds, etc.). As used herein the term "fragrance" refers to any mixture or composition comprising one or more perfume raw materials with or without one or more carrier solvents configured to emit a pleasant odor. Moreover, as used herein the term "perfume" refers to a compound utilized for its appealing odor. Compounds may have a pleasing odor without being used as a perfume in the context of this disclosure. Furthermore, the scent of the perfume may be designed to indicate a functional benefit such as freshness or cleanliness. For example, in some embodiments, the scent may smell similar to bleach, antiseptic, and/or flavors.

In one or more instances, the container 100 may include (e.g., be made of) one or more of containerboard, folding boxboard, solid bleached board, solid unbleached board, white lined chipboard, binder's board, corrugated fiberboard, or other materials. In additional embodiments, the container may include one or more polymers such as Polyester (PES), Polyethylene terephthalate (PET), Polyethylene (PE), High-density polyethylene (HDPE), Polyvinyl chloride (PVC), Polyvinylidene chloride (PVDC), Low-density polyethylene (LDPE), Polypropylene (PP), Polystyrene (PS), High impact polystyrene (HIPS), and Polyamides (PA).

Furthermore, although the container 100 is described in regard to FIG. 1 as having a general rectangular shape, the disclosure is not so limited. Rather, the container 100 may have any shape defining at least one cavity therein. For example, the container 100 may have a spherical shape, a canister/cylinder shape, a bottle shape, or any other shape.

Figure 2A:
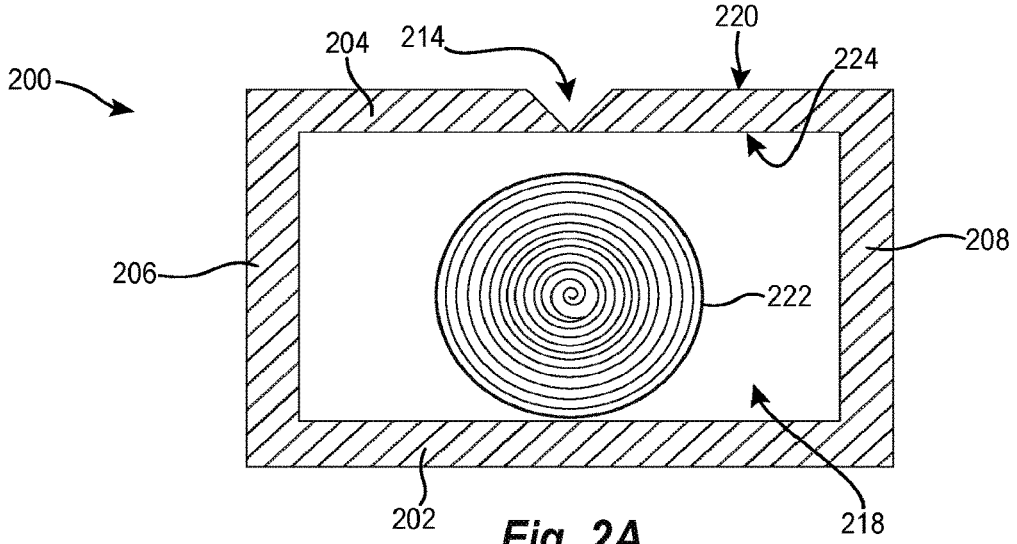
FIG. 2A shows a cross-sectional side view of a container housing a scented product according to an embodiment of the present disclosure.

FIG. 2A shows a cross-sectional longitudinal side view of a container 200 according to one or more embodiments of the present disclosure. Specifically, the plane defined by FIG. 2A is parallel to a longitudinal sidewall of the container 200. Additionally, elements of FIG. 2A (e.g., thicknesses of the walls of the container 200) may be exaggerated for clarity. Similar to the container 100 of FIG. 1, the container 200 includes a top wall 204, a bottom wall 202, lateral sidewalls 206, 208, longitudinal sidewalls (FIG. 1), a scented product 222 disposed within a cavity 218 of the container 200, and a vent 214 extending through the top wall 204 of the container 200. The container 200 is illustrated with only one vent 214 for clarity and to facilitate explanation of the operation of the vent 214. However, it is understood that the container 200 may contain a plurality of vents.

The vent 214 is illustrated in a closed position (i.e., as closed) in FIG. 2A. When closed, the vent 214 (and the surrounding container 200) may at least substantially prevent air from escaping the container 200 and/or entering the container 200. For example, when closed, the vent 214 may at least substantially prevent airflow through the vent 214. As a result, the vent 214 may at least substantially prevent a fragrance (e.g., fragrance particles) of the scented product 222 from escaping the container 200. By preventing air and/or fragrance particles from leaving the container 200 and airflow entering into the container when closed, the vent 214 may assist in maintaining a fragrance of the scented product 222 (i.e., may prevent fragrance loss).

In some embodiments, the vent 214 can have a general triangle shape. Specifically, the vent 214 may define a general triangular prism shape with a side (e.g., a planar side) of the triangular prism shape being coplanar with an exterior surface 220 of the top wall 204 and a corner edge of the triangular prism shape opposite the side (e.g., a point of a cross-sectional triangle of the triangular prism) intersecting a plane defined by the interior surface 224 of the top wall. Described differently, the vent 214 may include a V-shaped channel in the top wall 204. For instance, the channel may extend into the top wall 204 from the exterior surface 220, and a bottom (i.e., a point) of the channel may intersect the plane defined by the interior surface 224 of the top wall 204. Described yet another way, the vent 214 may be defined by two opposing wedge ends formed in the top wall. Narrow ends (e.g., the thin ends) of the two opposing wedge ends may contact each other when the vent is closed. The vent's shape is described in further detail below in regard to FIGS. 3A-3E.

Figure 2B:
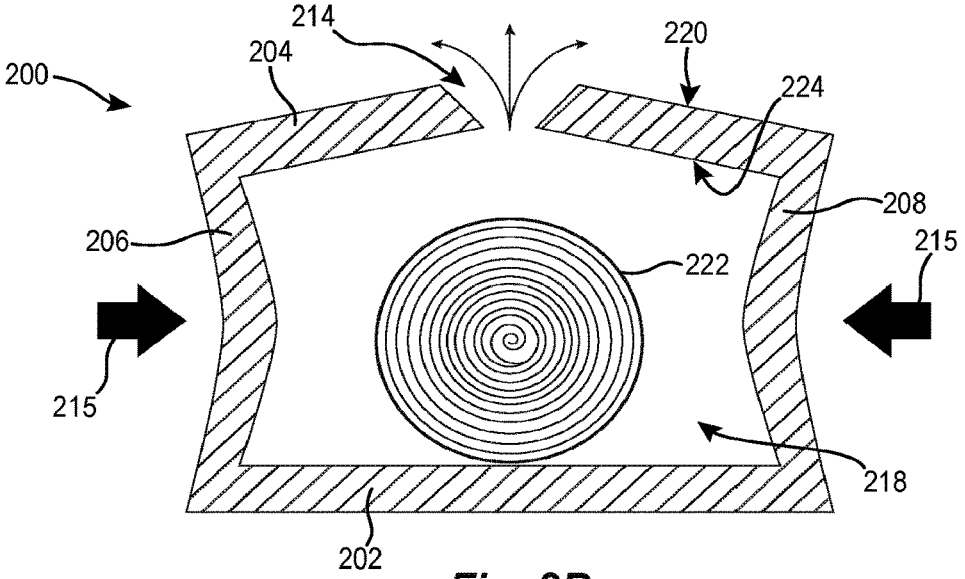
FIG. 2B shows a cross-sectional side view of the container of FIG. 1 with a vent of the container in an open position according to an embodiment of the present disclosure.

FIG. 2B shows a cross-sectional side view of the container 200 of FIG. 2A with the vent 214 in an open position. In operation, as noted above, the vent 214 of the container 200 can be opened by applying force (represented by arrow 215) to one or more of the lateral sidewalls 206, 208 and longitudinal sidewalls (FIG. 1) of the container 200. For example, as illustrated in FIG. 2B, the vent 214 of the container 200 can be opened when force 215 is applied to the lateral sidewalls 206, 208 of the container 200. Specifically, when force 215 is applied to the lateral sidewalls 206, 208 of the container 200, the lateral sidewalls 206, 208 may flex (e.g., bend, bow, etc.), which causes the top wall 204 to also flex, which, in turn, causes the vent 214 to at least partially open. For example, due to the lateral sidewalls 206, 208 flexing, the top wall 204 may bow outward (i.e., away from a center of the container), which causes the vent 214 to at least partially open. For instance, due to the top wall 204 flexing, the portions of the top wall 204 (e.g., the opposing wedge ends) defining the vent 214 may at least partially separate causing the vent 214 to open.

In alternative embodiments, the vent 214 of the container 200 can be opened by applying force 215 to one or more of the top wall 204 and a bottom wall 202 of the container 200. In further embodiments, the vent 214 may also be at least partially opened due to increased pressure within the cavity 218 of the container 200 caused by the force 215 applied to the lateral sidewalls 206, 208 of the container 200. For instance, when the force 215 is applied to the lateral sidewalls 206, 208 of the container 200 (i.e., a user squeezes the container), the lateral sidewalls 206, 208 may bow toward a center of the container 200 (i.e., inward) causing a pressure (e.g., an air pressure) within the cavity 218 of the container 200 to increase and may, in turn, cause the vent 214 to at least partially open to permit airflow through the vent 214 (i.e., to relieve the pressure within the cavity 218).

In some embodiments, the shape of the vent 214 may increase a likelihood that the vent will open when force 215 is applied to the container 200 (i.e., when the container 200 is squeezed). As discussed above, the vent 214 may be closed when narrow ends of opposing wedge ends contact each other. As a result, to open the vent 214, only the narrow ends of the opposing wedge ends need to be separated. For instance, less contacting surfaces need to be separated in order to open the vent 214 of the present disclosure in comparison to, for example, two opposing square ends (i.e., ends having parallel end surfaces), which would have the entire end surfaces contacting each other when closed. As noted above, the shape of the vent 214 is described in further detail in regard to FIGS. 3A-3F.

When the vent 214 is open (i.e., in an open position), the vent may permit air from within the container 200 to escape through the vent. For example, when the vent 214 is open, air from within the container 200 may pass through the vent 214. Furthermore, because a user squeezes the container to cause the vent 214 to open, increased pressure within the container 200 may cause at least some air to pass through the vent 214 (e.g., a puff of air through the vent 214). Moreover, the air escaping from the container 200 may include fragrance particles (e.g., may be scented) from the scented product 222. As a result, because the air is scented, a fragrance of the scented product 222 may be tested (e.g., smelled) by a user (e.g., a consumer). For instance, when the vent is open, the user may smell the scented product 222 disposed within the container 200.

By allowing a user to test the fragrance of the scented product 222, the container 200 of the present disclosure is advantageous over conventional containers of scented products. For example, unlike conventional containers that allow a user to test a fragrance (e.g., scratch and sniff containers), which often do not accurately reflect the actual fragrance of the scented product inside of the container, the container 200 of the present disclosure enables a user to accurately test (e.g., tryout) the fragrance of the scented product 222 prior to purchasing the scented product 222. Furthermore, by enabling a user to accurately test the fragrance of the scented product 222, the container 200 of the present disclosure enables a user to experiment with different scented products to discover (e.g., find) a scented product to the user's liking.

Additionally, because the vent 214 of the container 200 of the present disclosure can be selectively opened and closed by a user, the container 200 provides additional advantages over conventional containers. Specifically, because the vent 214 does not open until a force is applied to the sidewalls (e.g., longitudinal and/or lateral sidewalls 206, 208) of the container 200, the vent 214 may remain closed (e.g., at least substantially sealed) while the container 200 is not being manipulated, for example, while the container 200 is stationary on shelf of a store. In one or more embodiments, the vents are sized and configured to resist opening when subjected to forces typically associated with handling of a container (stocking, shipping, etc.). Along related lines, the container 200 protects the scented product 222 from airflow that may be caused by users (e.g., consumers) passing down aisles of a store. As a result of the foregoing, the container 200, even when housing the scented product 222, will not fill an aisle with the fragrance of the scented product 222 and alienate users (e.g., consumers) who do not want scented products 222.

Likewise, because the vent 214 will only open when manipulated by a user (e.g., squeezed by a user), the container 200 may maintain a fragrance of the scented product 222 in comparison to containers that have permanent apertures and/or permanently opened vents. In particular, in one or more embodiments, the vents are sized and configured to open when a force (e.g., a user squeezes the container) is applied that is greater than the forces typically associated with handling of a container (e.g., stocking or shipping). Thus, the vents of the container reduce fragrance lost by (i.e., a fragrance loss of) outer portions of the scented product 222. Moreover, because the vent 214 is selectively openable, the container 200 permits a user to selectively test different scented products within different containers.

Referring still to FIG. 2B, in one or more embodiments, a number of vents 214 (e.g., a number of vents included in the first and second pluralities of vents 114, 116 (FIG. 1)) may be controlled in order to allow for a sufficient fragrance release (e.g., enough fragrance so that a typical user can smell the fragrance) but avoiding noticeable fragrance loss to the scented product 222. For example, in some embodiments, the first and second pluralities of vents 114, 116 (FIG. 1) may each include two, three, five, ten, or more vents.

As noted above, in some embodiments, the vent 214 may not extend completely through the top wall 204 of the container 200. In such embodiments, a portion of the top wall 204 remaining at the vent 214 (i.e., the amount of the top wall 204 through which the vent 214 does not extend) may be sufficiently thin such that when a user squeezes the container 200, the portion breaks such that the vent 214 becomes selectively openable and closable. By forming the vent 214 such that the vent 214 does not extend completely through the top wall 204 of the container 200 originally, the vent 214 may further prevent fragrance loss during, for example, shipping and shelf time prior to first being tested by a user. The foregoing may result in yet less fragrance loss in comparison to conventional containers.

Figure 2C:
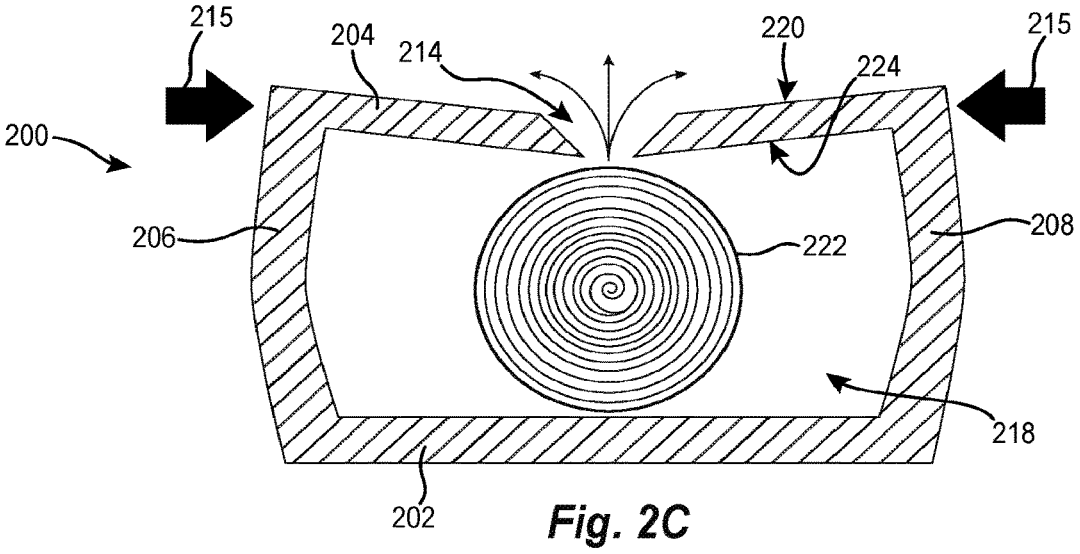
FIG. 2C shows a cross-sectional side view of the container of FIG. 1 with a vent of the container in an open position according to another embodiment of the present disclosure.

In one or more embodiments, how the vent 214 of the container 200 opens is dependent on where the force 215 is applied to the container 200 (e.g., where the container 200 is squeezed by the user). For example, FIG. 2C shows a cross-sectional view of the container 200 of FIG. 2B with the vent 214 open according to another embodiment of the present disclosure. As illustrated in FIG. 2C, in some instances, in response to a force 215 being applied to sidewalls (e.g., the lateral sidewalls 206, 208 and/or longitudinal sidewalls (FIG. 1)), the top wall 204 of the container 200 may bow inward instead of outward, which also causes the vent 214 to at least partially open. For example, in some cases, the closer to the top wall 204 the force 215 is applied on the sidewalls, the more likely the top wall 204 is to bow inward instead of outward. Furthermore, as noted above, in some instances, the force 215 may be applied to the top wall 204, and as a result, the top wall 204 may bow inward and may cause the vent 214 to at least partially open. Specifically, due to the top wall 204 bowing (i.e., flexing), the portions of the top wall 204 (e.g., the opposing wedge ends) defining the vent 214 may at least partially separate causing the vent 214 to open.

Referring to FIGS. 1-2C together, in additional embodiments, each vent of the plurality of vents 114, 116 may include a one-way vent (e.g., a one-way valve). In other words, each vent of the plurality of vents 114, 116 may generally allow fluids (e.g., air) to flow through the vent 114 in only one direction. In such embodiments, the first plurality of vents 114 may allow air to flow out of the container 200, and the second plurality of vents 116 may allow air to flow into the container 200, as will be discussed in greater detail in regard to FIGS. 4A and 4B.

Figure 3A:
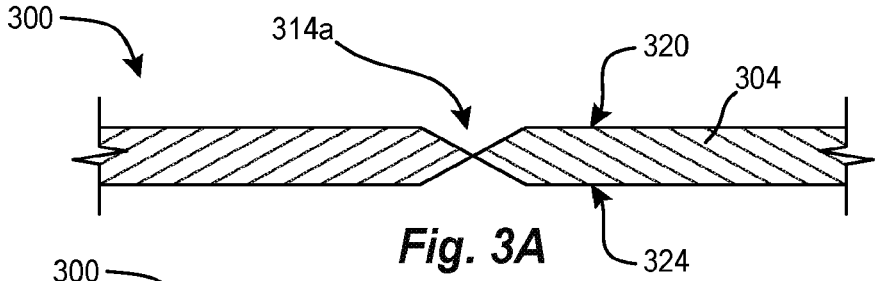
FIG. 3A is a partial cross-sectional side view of a top wall of a container with a vent extending there through according to an embodiment of the present disclosure.

FIGS. 3A-3E illustrate various types of vents of a container 300 according to various embodiments of the present disclosure. For example, FIG. 3A illustrates a vent 314*a* according to another embodiment of the present disclosure. The vent 314*a* may include two opposing wedge ends with narrow ends of the opposing wedge ends contacting each other. The narrow ends (e.g., the points) of the opposing wedge ends, when the vent 314*a* is in a closed position, may intersect a central plane of the top wall 304, and the central plane may extend between the exterior surface 320 of the top wall 304 and the interior surface 324 of the top wall 304 and may be parallel to the exterior surface 320 and interior surface 324 of the top wall 304. Put another way, the vent 314*a* may have an at least general hourglass shaped cross-section.

The vent 314*a* illustrated in FIG. 3A may facilitate the vent 314*a* opening both ways (e.g., bowing inward and outward, as describe above in regard to FIGS. 2B and 2C) with equal amounts of force 215 (FIG. 2B). For example, the vent 314*a* may be as likely to open inward as the vent 314*a* is to open outward. As a result, the vent 314*a* may maximize a likelihood that the vent 314*a* will open when a force 215 (FIG. 2B) is applied to the sidewalls of the container 300 regardless of where the force 215 (FIG. 2B) is applied on the sidewalls.

Figure 3B:
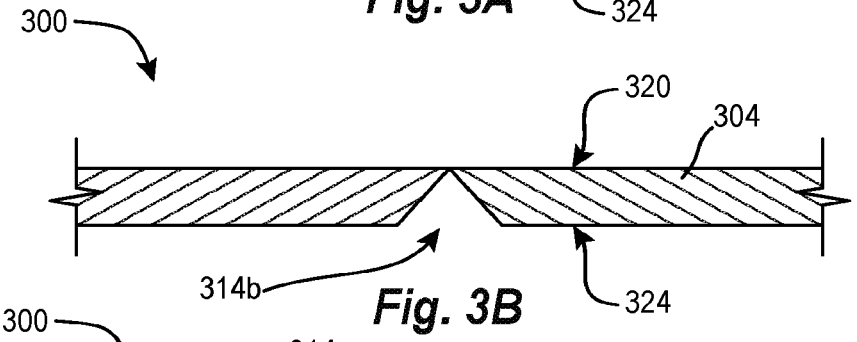
FIG. 3B is a partial cross-sectional side view of a top wall of a container with a vent extending there through according to an embodiment of the present disclosure.

FIG. 3B illustrates a vent 314*b* according to another embodiment of the present disclosure. The vent 314*b* may be similar to the vent 214 described in regard to FIG. 2A. For example, the vent 314*b* can include (e.g., have) a general triangle shape and may define a triangular prism shape with a side of the triangular prism shape being coplanar with an interior surface 324 of the top wall 304 and a corner edge of the triangular prism shape opposite the side intersecting a plane defined by an exterior surface 320 of the top wall 304. Put another way, the vent 314*b* can include a V-shaped channel in the top wall 304, where the channel extends into the top wall 304 from the interior surface 324, and where a bottom (i.e., a point) of the channel intersects the plane defined by the exterior surface 320 of the top wall 304.

In some embodiments, the vent 314*b* illustrated in FIG. 3B may be utilized to make the vent 314*b* less visible from an exterior of the container 300. Specifically, the vent 314*b* may include the same functionality as the vent 214 described above in regard to FIG. 2A but may, in some instances, be more aesthetically pleasing because the vent 314*b* may be less noticeable from an exterior of the container 300.

Figure 3C:
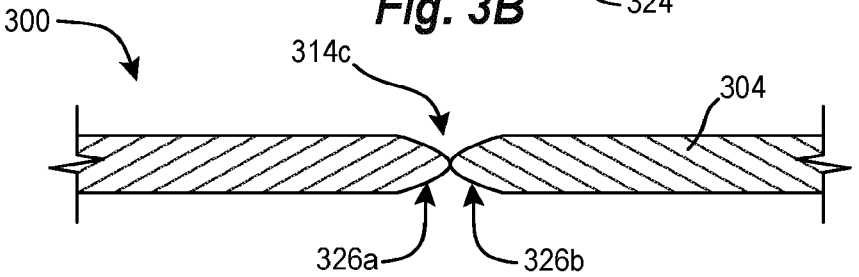
FIG. 3C is a partial cross-sectional side view of a top wall of a container with a vent extending there through according to an embodiment of the present disclosure.

FIG. 3C illustrates a vent 314*c* according to another embodiment of the present disclosure. The vent 314*c* may include two opposing curved surfaces 326*a*, 326*b* with the peaks of the two opposing curved surfaces 326*a*, 326*b* contacting each other when the vent 314*c* is closed. Furthermore, the peaks of the two opposing curved surfaces 326*a*, 326*b*, when in a closed position, may intersect the central plane of the top wall 304. Moreover, the vent 314*c* may maximize a likelihood that the vent 314*c* will reseal after being opened. Specifically, because the vent 314*c* is defined by two opposing curved surfaces 326*a*, 326*b*, the vent 314*c* may include more viable surfaces with which to seal than the narrow ends of wedges.

Figure 3D:
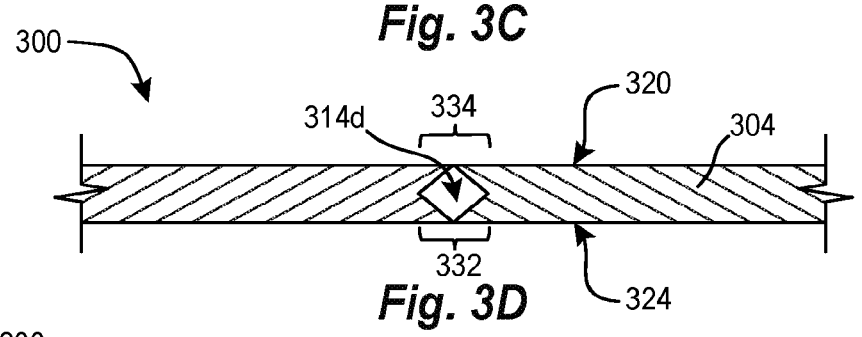
FIG. 3D is a partial cross-sectional side view of a top wall of a container with a vent extending there through according to an embodiment of the present disclosure.

FIG. 3D illustrates a vent 314*d* according to another embodiment of the present disclosure. As shown, the vent 314*d* may be defined by two sets of opposing wedges 332, 334 defining an at least generally rectangular shaped prism void extending through the top wall in a direction parallel to the exterior surface 320 of the top wall 304. Each set of the opposing wedges 332, 334 includes two opposing wedges with narrow ends of the two opposing wedges contacting each other. The narrow ends of a first set of the opposing wedges 332 may intersect a plane defined by the interior surface 324 of the top wall 304, and the narrow ends of a second set of the opposing wedges 334 may intersect a plane defined by the exterior surface 320 of the top wall 304.

Furthermore, the vent 314*d* increases a likelihood that the vent 314*d* will reseal after being open. Specifically, because the vent 314*d* includes two sets of opposing wedges 332, 334, the vent 314*d* includes two sets of narrow ends, and therefore, includes more surfaces with which the vent 314*d* can reseal. For example, the vent 314*d* includes double the surface area for resealing in comparison to the vent 214 described in regard to FIG. 2A, and therefore, is more likely to reseal after being opened.

Figure 3E:
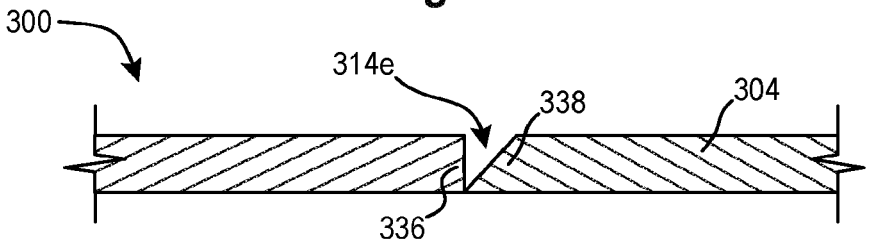
FIG. 3E is a partial cross-sectional side view of a top wall of a container with a vent extending there through according to an embodiment of the present disclosure.

FIG. 3E illustrates a vent 314*e* according to another embodiment of the present disclosure. As shown, the vent 314*e* is be defined by a square end 336 and a wedge end 338. Furthermore, when in a closed position, a narrow end of the wedge end 338 contacts the square end 336 of the vent 314*e*. Moreover, the vent 314*e* includes an increased amount of available surface area for resealing (i.e., the entire end surface of the square end 336 in comparison to a mere narrow end of a wedge end) while having a same amount of actual contacting surface areas (i.e., the narrow end of the wedge end 338 contacting the square end 336) as the vent 214 described in regard to FIG. 2A. As result, the vent 314*e* increases a likelihood of resealing while maintaining a likelihood that the vent 314*e* will open.

Figure 4A:
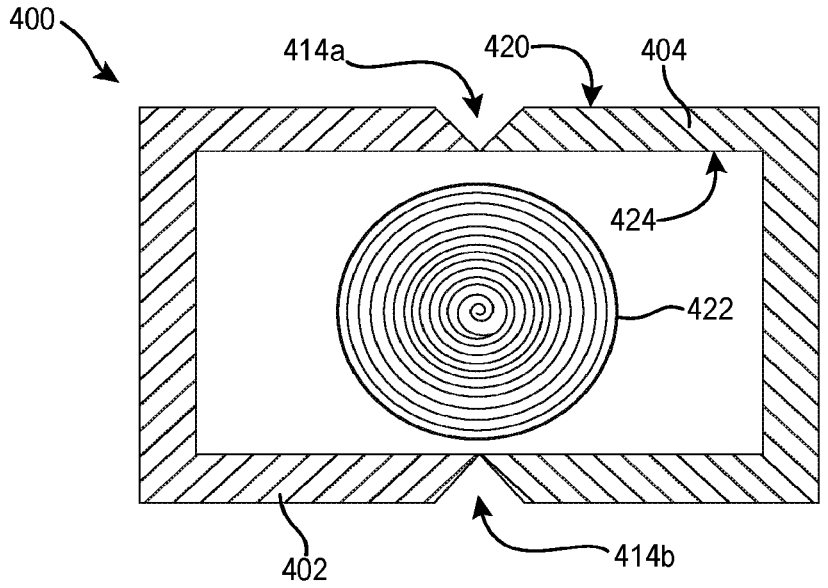
FIG. 4A is a cross-sectional side view of a container having a first vent extending through a top wall of the container and a second vent extending through a bottom wall of the container according to another embodiment of the present disclosure.

As noted above in regard to FIG. 1, in some embodiments, the container 100 can include a first plurality of vents 114 extending through a first wall of the container 100 and a second plurality of vents 116 extending through an opposing wall of the container 100. For example, FIG. 4A illustrates a cross-sectional side view of a container 400 having a first vent 414*a* extending through a top wall 404 of a container 400 and a second vent 414*b* extending through a bottom wall 402 of the container 400 according to an embodiment of the present disclosure. In particular, the first vent 414*a* is similar to the vent 214 described above in regard to FIG. 2A. For example, the first vent 414*a* includes a general triangular prism shape with a side of the triangular prism shape being coplanar with an exterior surface 420 of the top wall 404 and a corner edge of the triangular prism shape opposite the side intersecting a plane defined by the interior surface 424 of the top wall 404. Put another way, the first vent 414 can include a V-shaped channel in the top wall 404, where the channel extends into the top wall 404 from the exterior surface 420, and where a bottom (i.e., a point) of the channel intersects the plane defined by the interior surface 424 of the top wall 404. In additional embodiments, the first vent 414*a* may include any of the types of vents described above in regard to FIGS. 3A-3E.

Additionally, the second vent 414*b* is also similar to the vent 214 described above in regard to FIG. 2A. For example, the second vent 414*b* includes a general triangular prism shape with a side of the triangular prism shape being coplanar with an exterior surface 420 of the bottom wall 402 and a corner edge of the triangular prism shape opposite the side intersecting the plane defined by the interior surface 424 of the bottom wall 402. Put another way, the second vent 414*b* can include a V-shaped channel in the bottom wall 402, where the channel extends into the bottom wall 402 from the exterior surface 420, and where a bottom (i.e., a point) of the channel intersects the plane defined by the interior surface 424 of the bottom wall 402. In additional embodiments, the second vent 414*b* may include any of the types of vents described above in regard to FIGS. 3A-3E.

In one or more embodiments, the first vent 414*a* and the second vent 414*b* may include the same types of vents (e.g., the embodiment illustrated in FIG. 4A). In additional embodiments, the first vent 414*a* may include a first type of vent (e.g., the type of vent illustrated in FIG. 2A) and the second vent 414*b* may include a second different type of vent (e.g., the type of vent illustrated in FIG. 3A).

Figure 4B:
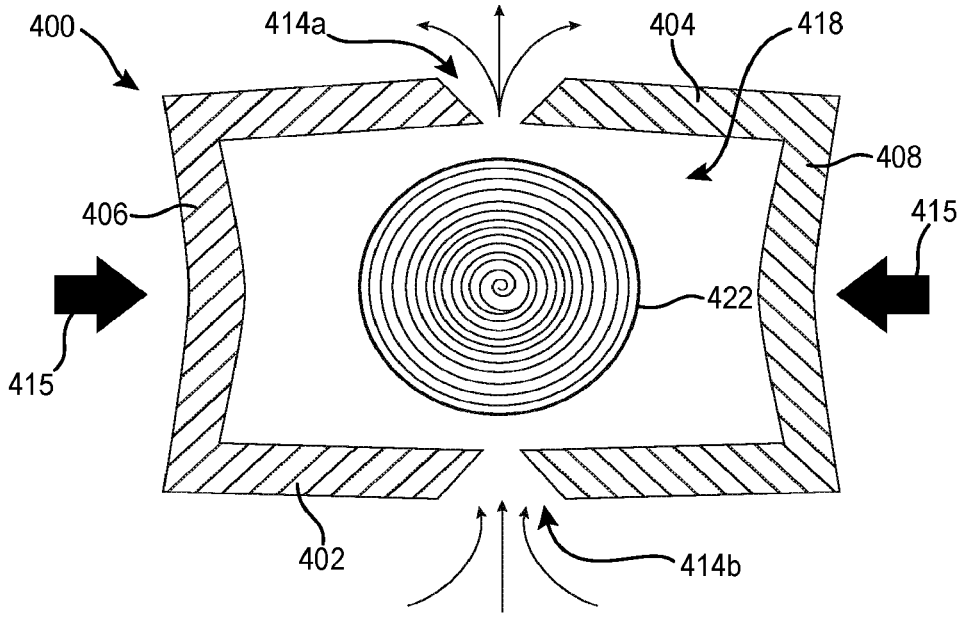
FIG. 4B is a cross-sectional side view of the container of FIG. 4A with the first vent and the second vent in open positions.

FIG. 4B shows a cross-sectional side view of the container 400 of FIG. 4A with the first vent 414*a* and the second vent 414*b* in open positions. Similar to the vent 214 described above in regard to FIG. 2B, the first vent 414*a* and the second vent 414*b* can be opened by applying force 415 to one or more of the lateral sidewalls 406, 408 and longitudinal sidewalls of the container 400. For example, as illustrated in FIG. 4B, the first vent 414*a* and the second vent 414*b* of the container 400 can be opened when force 415 is applied to the lateral sidewalls 406, 408 of the container 400. Specifically, when force 415 is applied to the lateral sidewalls 406, 408 of the container 400, the lateral sidewalls 406, 408 may flex (e.g., bend, bow, etc.), which causes the top wall 404 and the bottom wall 402 to also flex (e.g., bow outward), which, in turn, causes the first vent 414*a* and the second vent 414*b* to at least partially open. For instance, due to the top wall 404 flexing, the portions of the top wall 404 defining the first vent 414*a* may at least partially separate causing the first vent 414*a* to open. Similarly, due to the bottom wall 402 flexing, the portions of the bottom wall 402 defining the second vent 414*b* may at least partially separate causing the second vent 414*b* to open. As a non-limiting example, in use, the first vent 414*a* and the second vent 414*b* may open when a user squeezes the container 400, as described above.

When the first vent 414*a* and the second vent 414*b* of the container 400 are open, as illustrated in FIG. 4B, the first vent 414*a* and the second vent 414*b* may permit air to enter into the container 400 via one of the vents (e.g., the second vent 414*b*), pass over the scented product 422, and exit the container 400 through the other vent (e.g., the first vent 414*a*). Specifically, in use, when a user squeezes the container 400 to open the first and second vents 414*a*, 414*b* and sniffs the container 400 proximate to the first vent 414*a*, the act of sniffing may cause air to pass through the container 400 (i.e., through the first and second vents 414*a*, 414*b*), pass over the scented product 422, pick up fragrance particles from the scented product 422, and enter the user's olfactory system such that the user can smell the scented product 422.

In addition to allowing air to flow over the scented product 422 and permitting a user to smell the scented product 422, placing the first vent 414*a* (or first plurality of vents) in the top wall 404 and the second vent 414*b* (or second plurality of vents) in the bottom wall 402 may minimize fragrance loss in comparison to placing the first and second vents 414*a*, 414*b* in a sidewall of the container 400. For example, the bottom wall 402 of the container 400 will typically be in contact with a store shelf or another container (e.g., another carton of trash bags), and thus, the second vent 414*b* in the bottom wall 402 will be shielded from most airflow, which can cause fragrance loss, while in contact with the store shelf and/or another container. Furthermore, the top wall 404 of the container 400 will typically be in contact with another container or, at least, will typically not directly face an aisle where users walk past causing airflow, and thus, will typically not be exposed to coincidental airflow caused by users. As a result, the top wall 404 of the container 400 also avoids most airflow except when being handled by a user.

In view of the foregoing, because the placement of the first vent 414*a* and the second vent 414*b* helps to minimize exposure to airflow, the container 400 of the present disclosure may minimize fragrance loss of the scented product 422. Specifically, because an exposure of the first vent 414*a* and the second vent 414*b* is minimized, airflow into and out of the container 400 is minimized, and because airflow into and out of the container 400 is minimized, the fragrance (i.e., fragrance particles) of the scented product 422 remains within the container 400.

Figure 5:
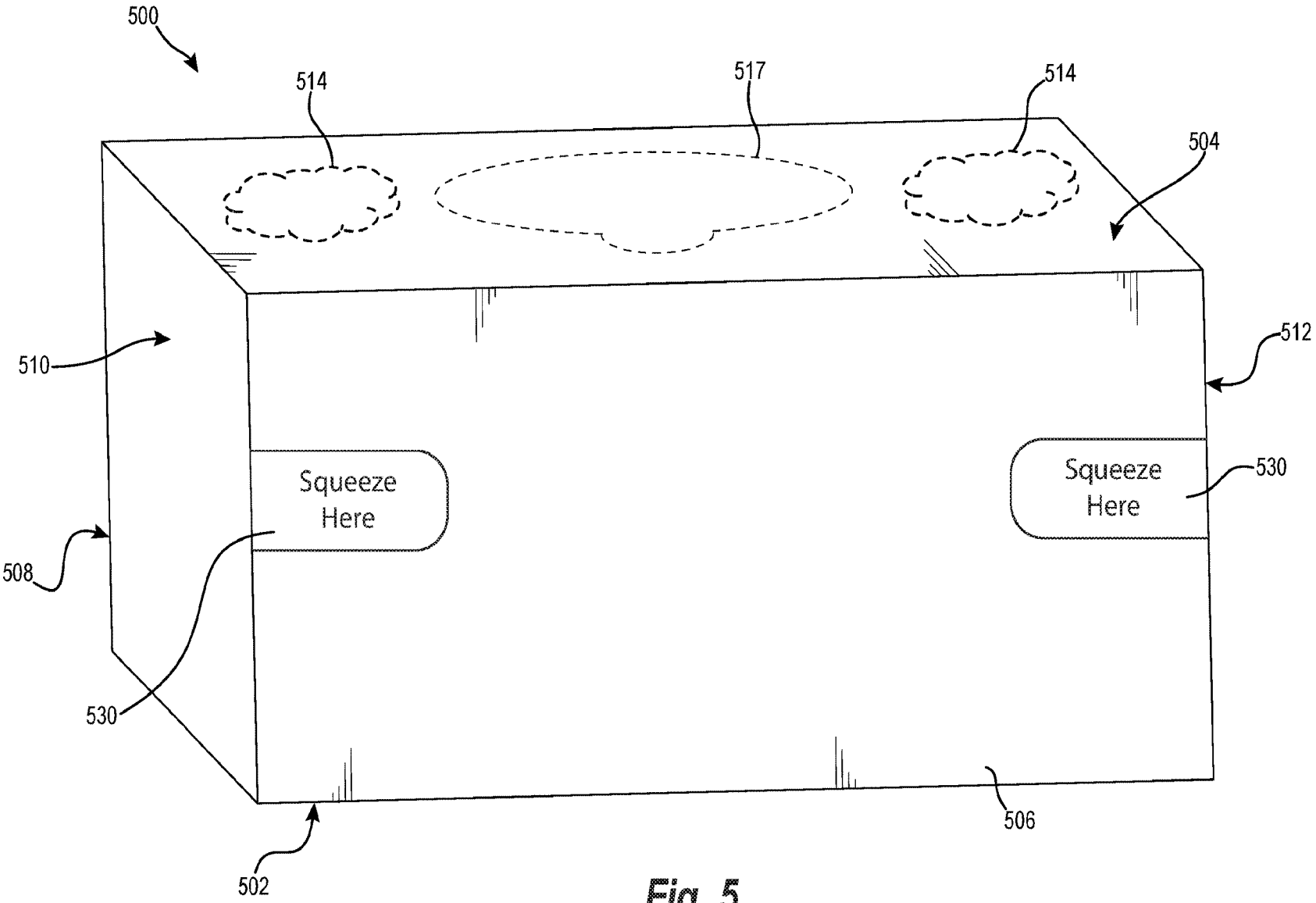
FIG. 5 shows a perspective view of a container for housing a scented product according to another embodiment of the present of the present disclosure.

FIG. 5 illustrates a container 500 for housing a scented product according to another embodiment present disclosure. Similar to the container 100 described above in regard to FIG. 1, the container 500 includes a bottom wall 502, a top wall 504, a plurality of lateral sidewalls 506, 508, a plurality of longitudinal sidewalls 510, 512, a first plurality of vents 514, and a perforated opening 517. Additionally, similar to the container 100 of FIG. 1, the first plurality of vents 514 may extend through the top wall 504 of the container 500. In addition to the first plurality of vents 514, the container 500 includes one or more designated regions 530 (e.g., thumbprints) indicating to a user where to apply force 215 (FIG. 2B) to (e.g., squeeze) the container 500 in order to test (e.g., smell) the fragrance of the scented product 222 (FIG. 2A). Moreover, in some embodiments, the container 500 may include a second plurality of vents 116 (FIG. 1) extending through the bottom wall 502 of the container 500.

As illustrated, in some instances, the first plurality of vents 514 may be oriented relative to one another in a pattern. For example, the first plurality of vents 514 may be oriented in a pattern representing a fragrance of the scented product 222 (FIG. 2A) disposed within a cavity 118 (FIG. 1) of the container 500. Specifically, the first plurality of vents 514 may be oriented in a shape of one or more of a cloud, a flower, a Hawaiian aloha, a sunburst, a fruit, a vegetable, a plant, a leaf, or any other shape representing a fragrance. Furthermore, the first plurality of vents 514 may include any of the types of vents described above in regard to FIGS. 2A-3E.

As noted above, the container 500 may also include one or more designated regions 530 indicating to the user where to apply force 215 (FIG. 2B) to (e.g., squeeze) the container 500. In some embodiments, the one or more designated regions 530 may include one or more thumbprints associated with text (e.g., messaging) reciting, for example, "squeeze here," "press here," "squeeze here for a burst of freshness," etc. In one or more embodiments, the one or more designated regions 530 may be disposed (e.g., located) on one or more of the lateral sidewalls 506, 508 and longitudinal sidewalls 510, 512 of the container 500. In additional embodiments, the one or more designated regions 530 may be disposed on the top wall 504 proximate to (e.g., next to or adjacent to) the first plurality of vents 514.

As mentioned briefly above, in one or more embodiments, the container may include a second plurality of vents extending through the bottom wall 502 of the container. Similar to the first plurality of vents 514, the second plurality of vents may be oriented in a pattern representing a fragrance. Furthermore, in such embodiments, one or more of the designated regions 530 may be disposed on the bottom wall 502 proximate to the second plurality of vents. Moreover, the second plurality of vents 116 (FIG. 1) may include any of the vents described in regard to FIGS. 2A-3E.

Although the first plurality of vents and the second plurality of vents are described herein as being selectively openable and closable, the disclosure is not so limited. For example, in some embodiments, the vents can include holes that are constantly (e.g., permanently) open (referred to hereinafter as "open vents"). For instance, the first plurality of vents and the second plurality of vents may not be closable and may merely include voids of material in the walls of the container. Specifically, FIGS. 6A-6E show open vents (e.g., first and second pluralities of vents) according to additional embodiments of the present of the present disclosure.

Figure 6A:
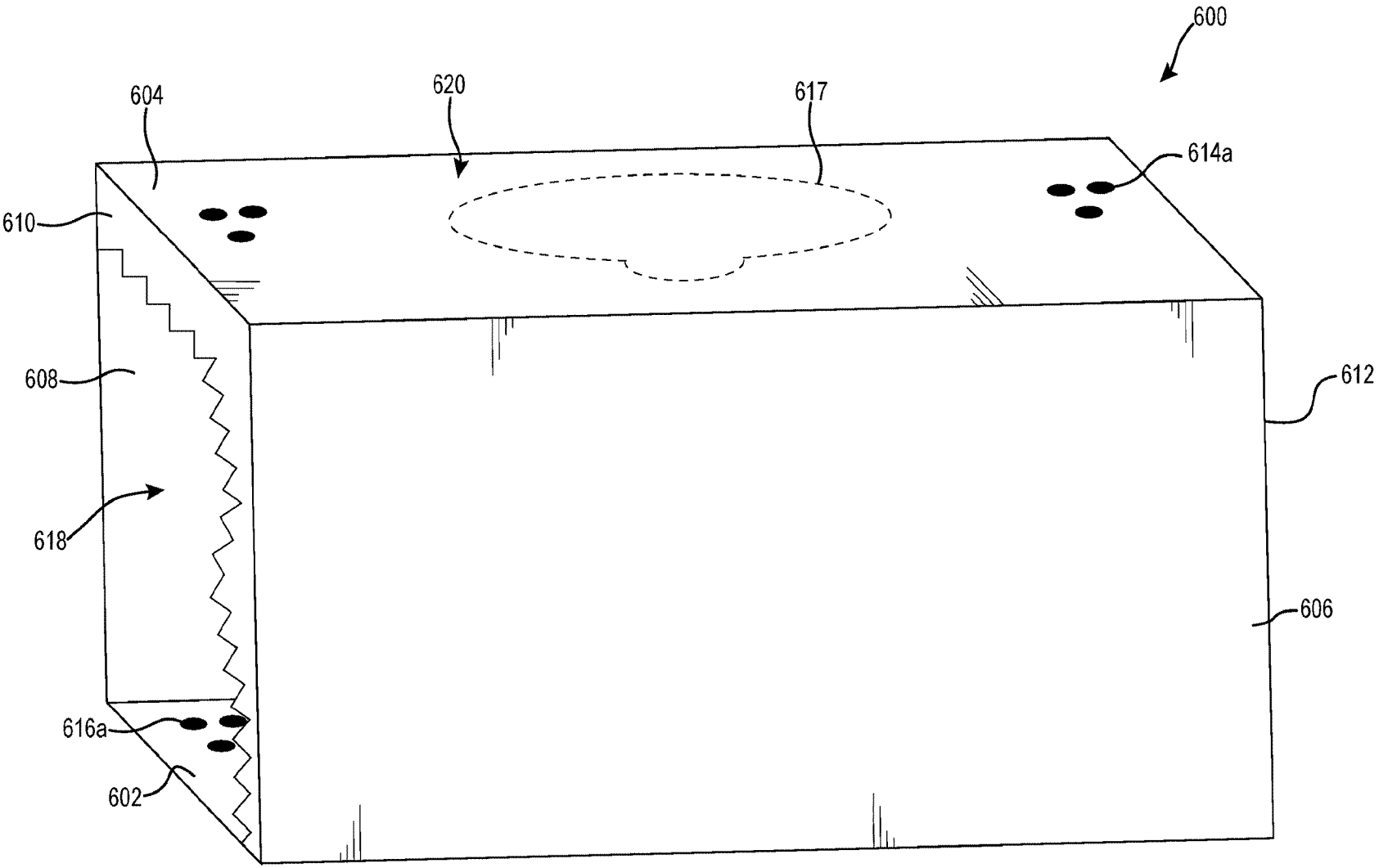
FIGS. 6A-6H show perspective views of containers for housing scented products according to additional embodiments of the present disclosure.
Figure 6B:
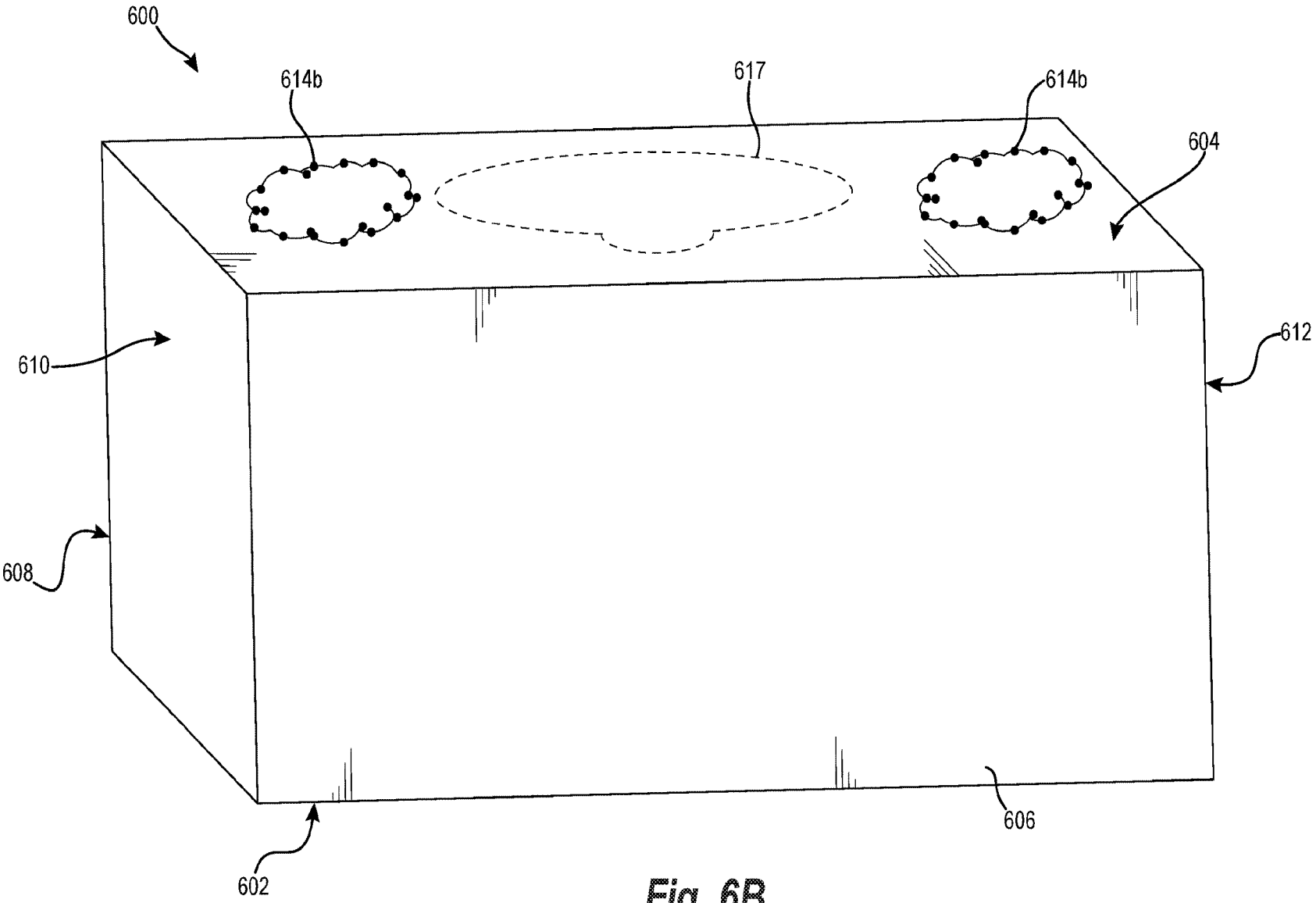
Figure 6C:
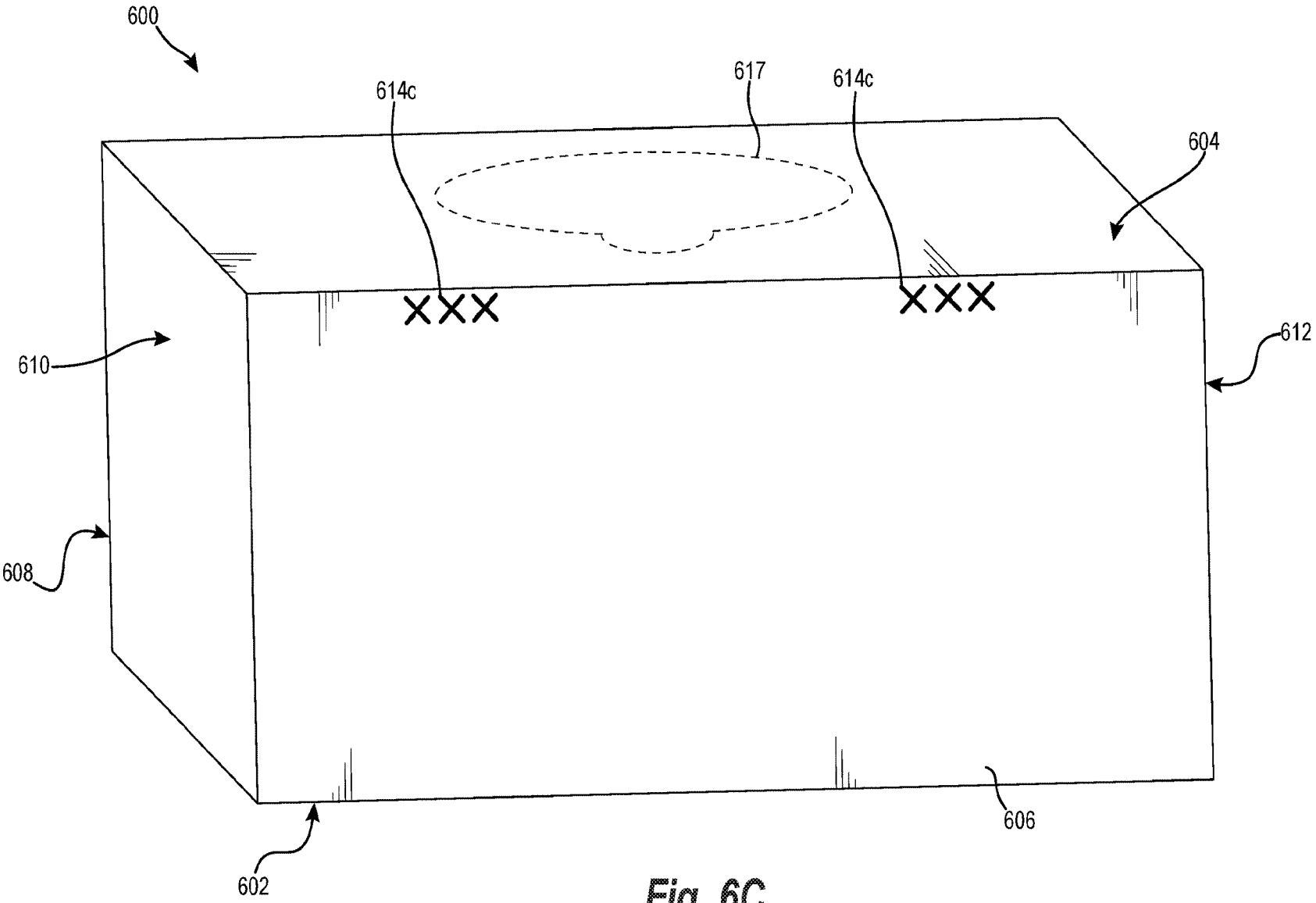
Figure 6D:
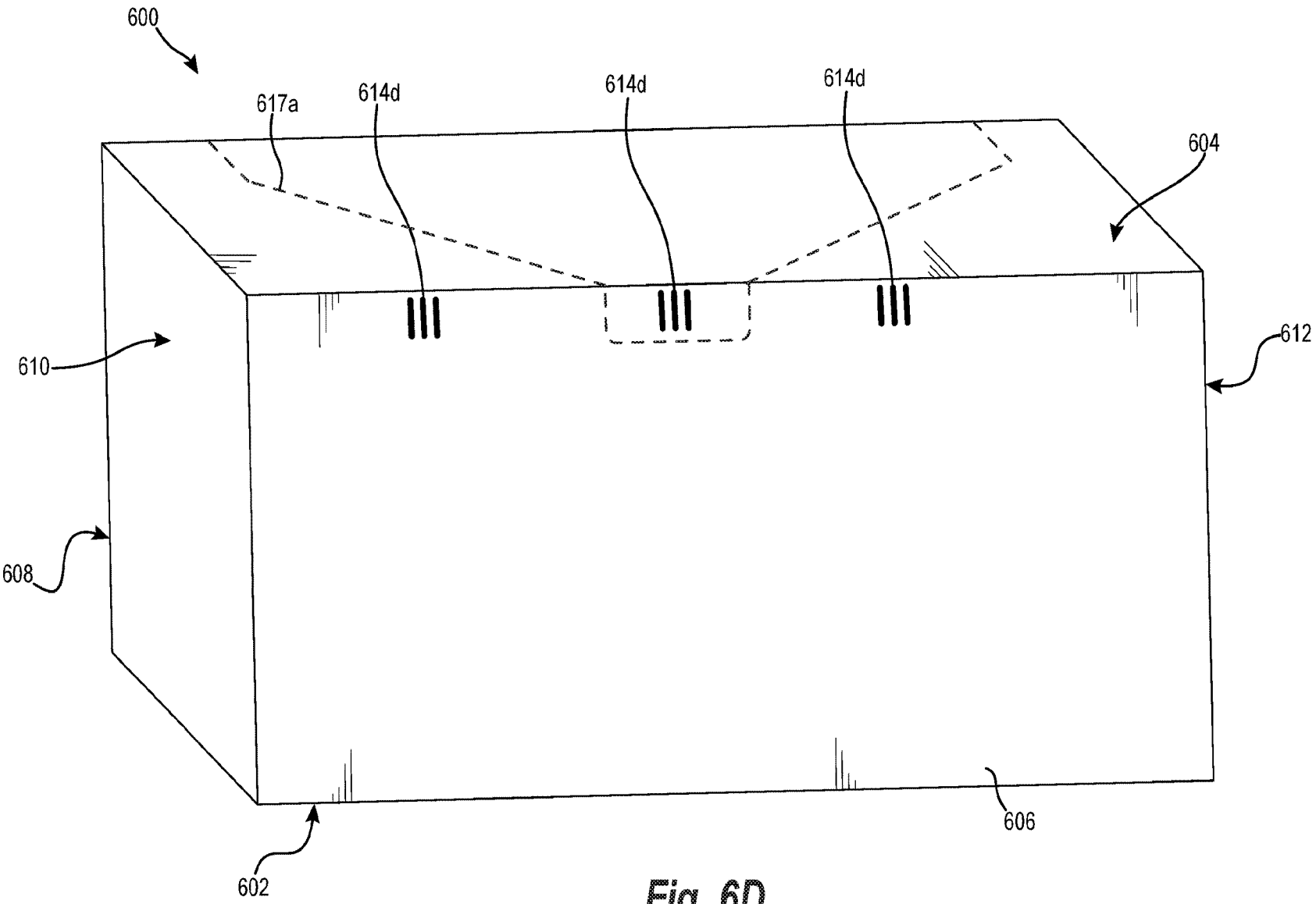
Figure 6E:
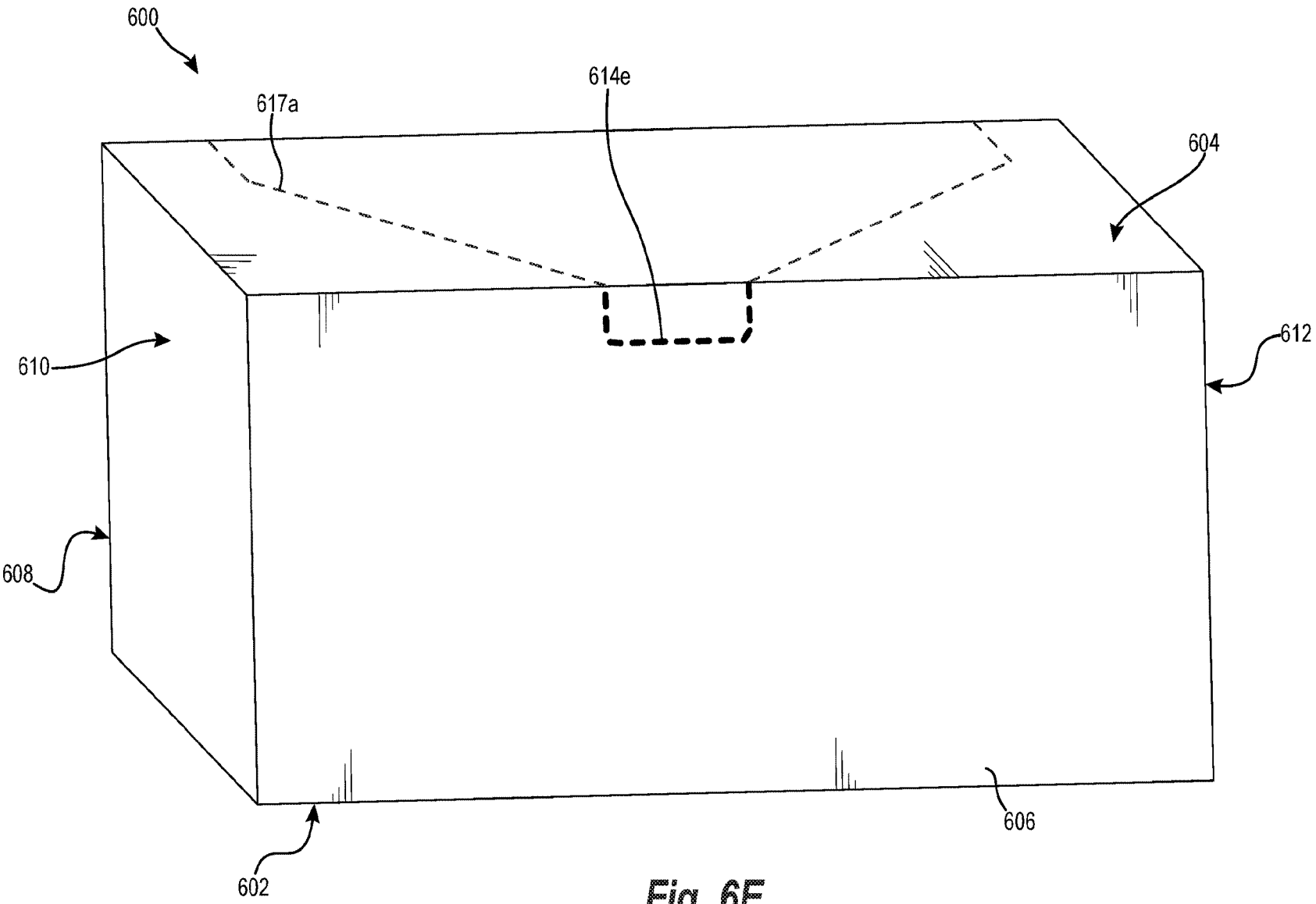
Figure 6F:
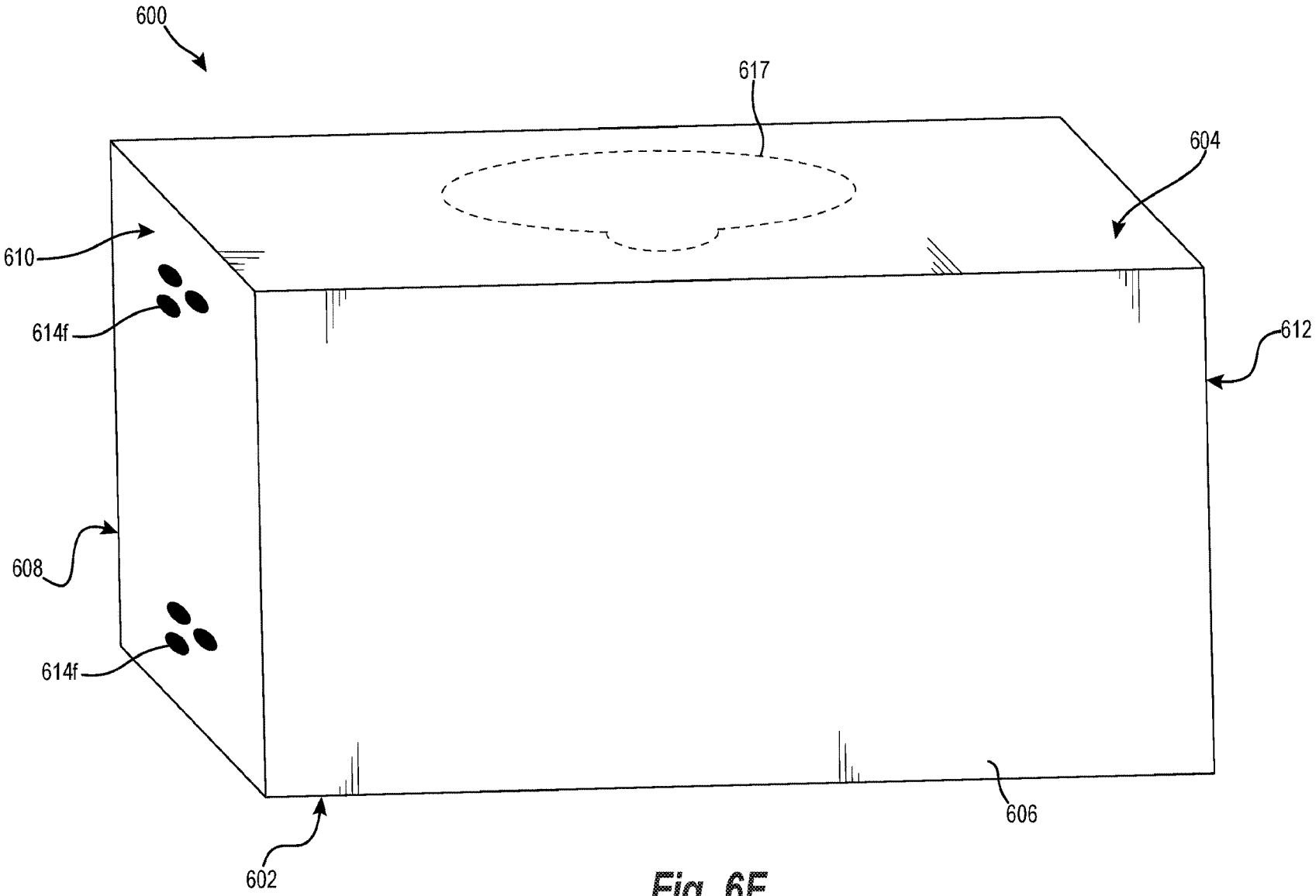
Figure 6G:
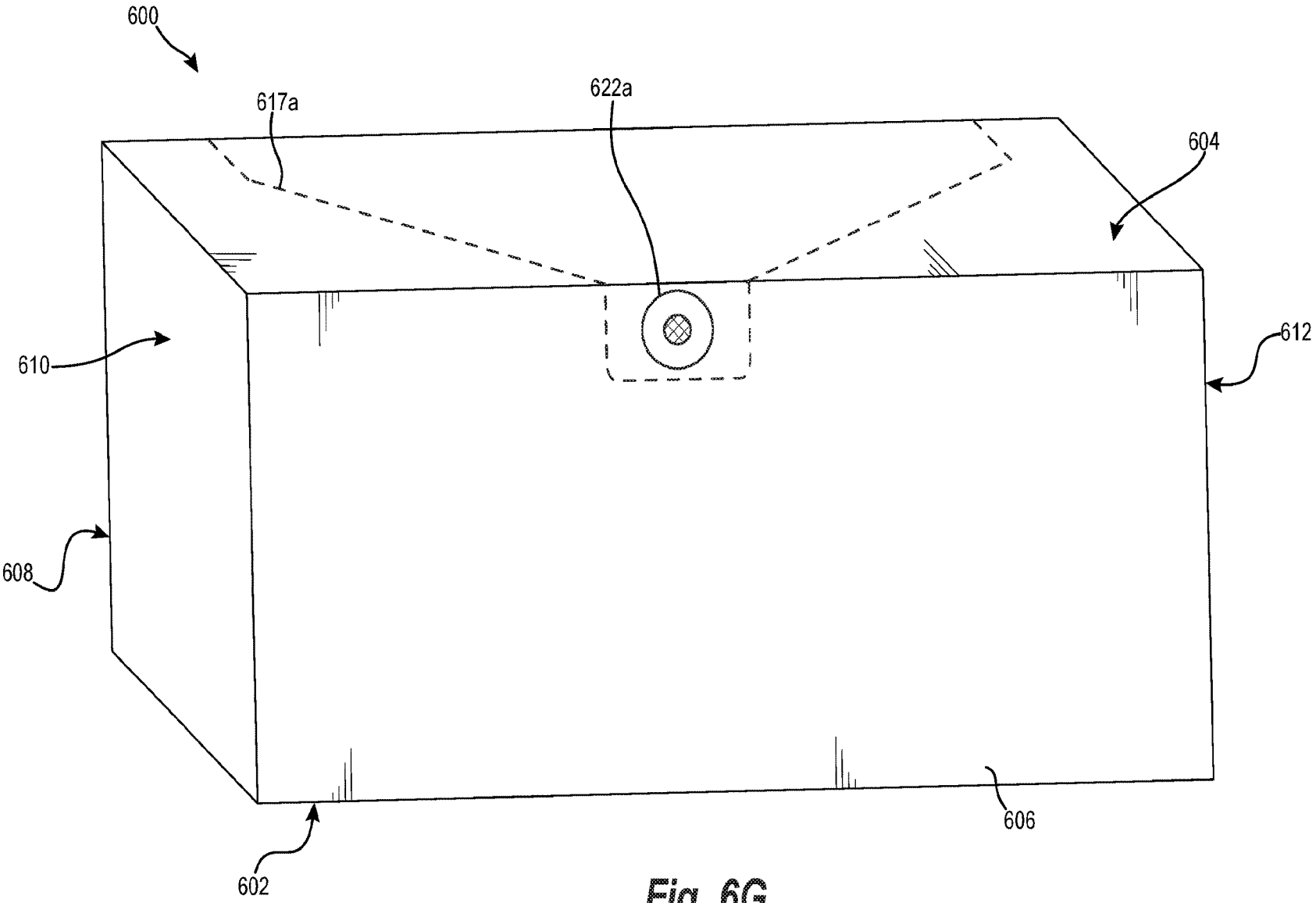
Figure 6H:
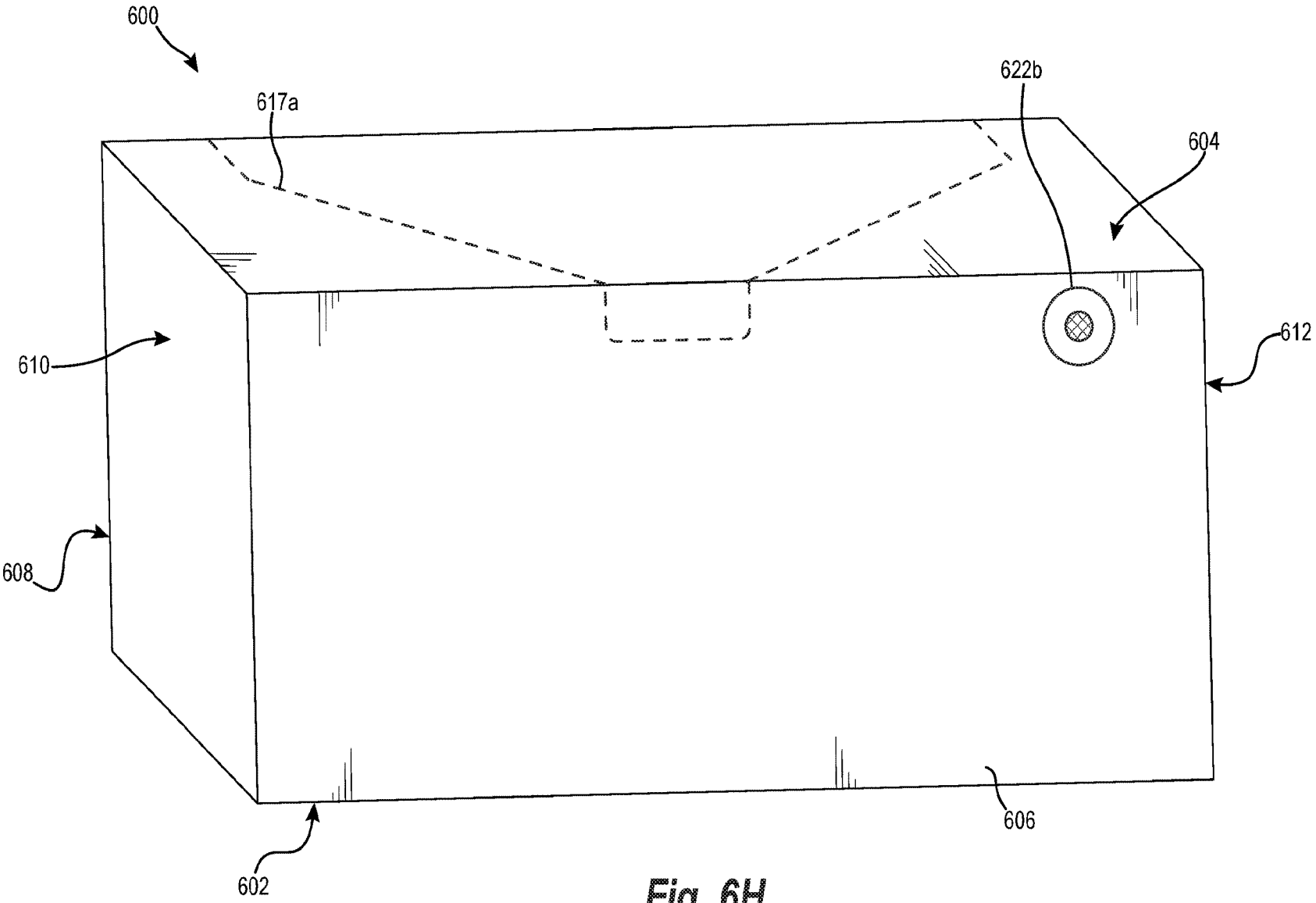

For example, as shown in FIG. 6A, a first and second pluralities of open vents 614*a*, 616*a* may have general circular shapes and may extend completely through the top wall 604 of the container 600. As another example, as shown in FIG. 6B, the first plurality of open vents 614*b* (and the second plurality of open vents (FIG. 6A)) may have general circular shapes and may be oriented relative to one another in a pattern (e.g., a cloud, a flower, a Hawaiian aloha, a sunburst, a fruit, a vegetable, a plant, a leaf, or any other shape representing a fragrance). As another non-limiting example, as shown in FIG. 6C, the first plurality of open vents 614*c* (and the second plurality of open vents (FIG. 6A)) may have general X-shapes and may extend through one or more wall of the plurality of lateral sidewalls 606, 608 and the plurality of longitudinal sidewalls 610, 612. As a further example, as shown in FIG. 6D, the first plurality of open vents 614*d* (and the second plurality of open vents (FIG. 6A)) may have general slit shapes and may extend through one or more wall of the plurality of lateral sidewalls 606, 608 and the plurality of longitudinal sidewalls 610, 612. Furthermore, as shown in FIG. 6D, in one or more embodiments the open vents 614*d* can be formed in a portion of the container that forms the opening to the container. FIG. 6E illustrates another embodiment in which the open vents 614*e* align with or are formed over the perforations 617*a*. One will appreciate in light of the disclosure herein that such a configuration can help reduce the noticeability of the vents. Furthermore, while FIG. 6E illustrates vents in the perforations 617*a* that form the opening to the container, in alternative embodiments the vents can be formed in other or additional perforations such as those intersecting walls or forming corners or edges of the container. FIG. 6F illustrates another embodiment in which the vents 614*f* (e.g., selectively openable and closable and/or open vents) extend through a sidewall (e.g., a longitudinal sidewall) of the container 600. FIGS. 6G and 6H illustrate another embodiment including one-way valves 622*a*, 622*b* extending through sidewalls of the container 600. As shown, in some embodiments, the one-way valves 622*a*, 622*b* may include aperture extending through a sidewall of the container 600 and a porous and/or breathable material disposed over the aperture.

Referring to FIGS. 1-6 together, although the container is described herein as having vents and/or valves extending through a wall of the container, the disclosure is not so limited. For example, in some embodiments, the container may include a vent extending through a wall of the container and an external valve disposed over the vent on an exterior and/or interior of the container. In some instances, the container may include a one-way valve (e.g., a "coffee" valve) disposed over the vent of the container. Furthermore, as noted above, the one-way valve may generally allow fluids (e.g., air) to flow through the valve in only one direction. In such embodiments, the container may include at least one one-way valve to permit fluids to escape the container and at least one one-way valve to permit fluids to enter into the container.

Figure 7:
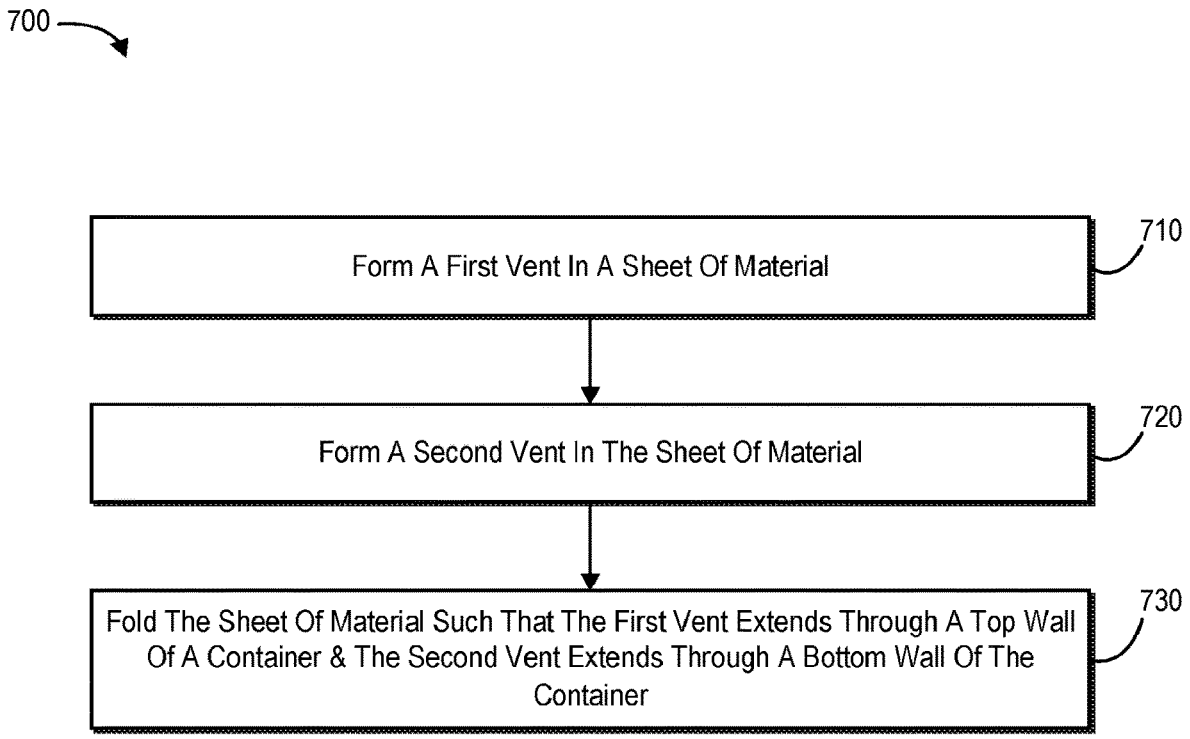
FIG. 7 shows flow diagram of a method of making a container for housing a scented product according to one or more embodiments of the present disclosure.

Some embodiments of the present disclosure include methods of making a container for housing a scented product. For example, FIG. 7 shows a flow diagram of a method 700 of making a container for housing a scented product. Referring to FIGS. 1 and 7 together, the method 700 may include forming a vent 114 in a sheet of material. For example, the method 700 may include forming a first plurality of vents 114 in the sheet of material, represented as act 710. Furthermore, the method 700 may include forming a second plurality vents in the sheet of material, represented as act 720. In more of more embodiments, forming a first plurality of vents 114 and the second plurality of vents 116 may include forming a first plurality of selectively openable and closable vents 114 and a second plurality of selectively openable and closable vents 116 in a sheet of material.

Furthermore, in one or more embodiments, forming the first plurality of vents 114 and the second plurality of vents 116 in the sheet of material may include punching and/or cutting the first plurality of vents 114 and the second plurality of vents 116 in the sheet of material. Additionally, forming the first plurality of vents 114 and the second plurality of vents 116 may include forming each vent of the first plurality of vents 114 and the second plurality of vents 116 to include an at least general triangular prism shape. Moreover, forming the first plurality of vents 114 may include forming each vent such that a side of the triangular prism shape of each vent is coplanar with an exterior surface of the top wall and a corner edge of the triangular prism shape of each vent, opposite the side, intersects a plane defined by an interior surface of the top wall 104. Likewise, forming the second plurality of vents 116 may include forming each vent such that a side of the triangular prism shape of each vent is coplanar with a plane defined by an exterior surface of the bottom wall 102 and a corner edge of the triangular prism shape of each vent, opposite the side, intersects an interior surface of the bottom wall 102.

In alternative embodiments, forming the first plurality of vents 114 may include forming each vent such that a side of the triangular prism shape of each vent is coplanar with a plane defined by an interior surface of the top wall 104 and a corner edge of the triangular prism shape of each vent, opposite the side, intersects an exterior surface of the top wall 104. Furthermore, forming the second plurality of vents 116 may include forming each vent such that a side of the triangular prism shape of each vent is coplanar with a plane defined by an interior surface of the bottom wall 102 and a corner edge of the triangular prism shape of each vent, opposite the side, intersects an exterior surface of the bottom wall 102.

Additionally, the method 700 may include folding the sheet of material such that the first vent extends through a top wall of a container and the second vent extends through a bottom wall of the container, represented as act 730. For example, the method 700 may include folding the sheet of material to form the container such that the first plurality of vents extends through a top wall of the container and the second plurality of vents extend through a bottom wall of the container. The sheet of material may include any of the materials described above in regard to FIG. 1. One will appreciate in view of the disclosure herein that the method 700 described in relation to FIG. 7 can be modified to omit or expanded acts, or vary the order of the various acts as desired.

The present disclosure may be embodied in other specific forms without departing from its spirit or essential characteristics. Thus, the described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

We claim:

1. A container for housing a scented product, comprising:
- a plurality of walls defining at least one cavity within the container;
- a plurality of scented trash bags disposed within the at least one cavity;
- a perforated opening formed in a top wall of the plurality of walls of the container, the perforated opening being selectably openable to allow access to the at least one cavity and the plurality of scented trash bags; and
- an open vent extending through a first wall of the plurality of walls of the container to the at least one cavity, wherein:
  - the open vent is positioned and oriented in the first wall to form part of a pattern representing a fragrance of the plurality of scented trash bags, and
  - the open vent allows the fragrance from the plurality of scented trash bags to pass through the container at a position of the pattern representing the fragrance without opening the container, such that access to the at least one cavity of the container is restricted when the perforated opening is unopened.

2. The container of claim 1, wherein the open vent comprises a circular shape.

3. The container of claim 1, wherein:
- the container comprises a rectangular shape formed by the plurality of walls, and
- a second wall of the plurality of walls comprises the perforated opening.

4. The container of claim 3, further comprising a perforated tab connected to the perforated opening, wherein:
- the perforated tab is positioned in the first wall;
- the first wall and the second wall connect along a corner of the container; and
- the perforated tab is configured to aid in opening the perforated opening.

5. The container of claim 3, wherein:
- the plurality of scented trash bags comprises a roll of scented trash bags, the roll of scented trash bags having two opposite ends;
- each of the two opposite ends of the roll of scented trash bags is proximate to one of two opposing end walls of the container; and
- a portion of the roll of scented trash bags between the two opposite ends of the roll of scented trash bags is visible through the open vent.

6. The container of claim 1, wherein the open vent is configured to allow air to flow out of the at least one cavity of the container to an exterior of the container at an increased rate when a force is applied to the container due to the open vent being positioned in a middle of the first wall that deflects more than sides of the first wall.

7. The container of claim 1, further comprising a plurality of open vents, wherein the open vent and the plurality of open vents are oriented to form part of the pattern representing the fragrance of the plurality of scented trash bags disposed within the at least one cavity of the container.

8. The container of claim 1, wherein the pattern representing the fragrance of the plurality of scented trash bags comprises a fruit or a vegetable.

9. The container of claim 1, wherein the pattern representing the fragrance of the plurality of scented trash bags comprises a cloud or a sunburst.

10. The container of claim 1, wherein the pattern representing the fragrance of the plurality of scented trash bags comprises a flower, a plant, or a leaf.

11. The container of claim 1, wherein the open vent is aligned with one or more perforations of the perforated opening.

12. The container of claim 1, further comprising a breathable material disposed over the open vent.

13. A container for housing a scented product, comprising:

a plurality of walls defining at least one cavity within the container;

a plurality of scented trash bags disposed within the at least one cavity;

a perforated opening formed in a top wall of the plurality of walls, the perforated opening being selectably openable to allow access to the at least one cavity and the plurality of scented trash bags; and a plurality of open vents extending through a first wall of the plurality of walls of the container to the at least one cavity, wherein:

the plurality of open vents is oriented in a pattern forming a shape representing a fragrance of the plurality of scented trash bags, and the plurality of open vents allows the fragrance from the plurality of scented trash bags to pass through the container at a position of the shape representing the fragrance without opening the container, such that access to the at least one cavity of the container is restricted when the perforated opening is unopened.

14. The container of claim 13, wherein the plurality of open vents is configured to allow air to flow out of the at least one cavity of the container to an exterior of the container.

15. The container of claim 13, wherein:

the container comprises a rectangular shape formed by the plurality of walls; and a second wall of the plurality of walls comprises the perforated opening.

16. The container of claim 15, further comprising a perforated tab connected to the perforated opening, wherein:

the perforated tab is positioned in the first wall;

the first wall and the second wall connect along a corner of the container; and the perforated tab is configured to aid in opening the perforated opening.

17. The container of claim 13, wherein the shape representing the fragrance of the plurality of scented trash bags comprises a fruit or a vegetable.

18. The container of claim 13, wherein the shape representing the fragrance of the plurality of scented trash bags comprises a cloud or a sunburst.

19. The container of claim 13, wherein the shape representing the fragrance of the plurality of scented trash bags comprises a flower, a plant, or a leaf.

20. The container of claim 13, wherein one or more vents of the plurality of open vents are aligned with perforations e perforated opening.

* * * * *